US009003610B2

(12) United States Patent
Schleucher et al.

(10) Patent No.: US 9,003,610 B2
(45) Date of Patent: Apr. 14, 2015

(54) CLOSURE CLIP AND DIE FOR CLOSING SAID CLIP

(75) Inventors: Heiko Schleucher, Gedern (DE); Uwe Melchert, Frankfurt (DE)

(73) Assignee: Poly-clip System GmbH & Co. KG, Hattersheim (DE)

( * ) Notice: Subject to any disclaimer, the term of this patent is extended or adjusted under 35 U.S.C. 154(b) by 781 days.

(21) Appl. No.: 13/083,370

(22) Filed: Apr. 8, 2011

(65) Prior Publication Data

US 2011/0247300 A1 Oct. 13, 2011

(30) Foreign Application Priority Data

Apr. 9, 2010 (EP) ..... 10003830

(51) Int. Cl.

| | |
|---|---|
| ***F16G 11/04*** | (2006.01) |
| ***B65B 67/06*** | (2006.01) |
| ***B65B 51/04*** | (2006.01) |
| ***B65D 33/16*** | (2006.01) |

(52) U.S. Cl.

CPC ..... *B65B 67/06* (2013.01); *B65B 51/043* (2013.01); *B65D 33/1641* (2013.01)

(58) Field of Classification Search

USPC ..... 24/30.51, 30.5 R, 703.1, 703.2, 703.5; 53/138.4

See application file for complete search history.

(56) References Cited

U.S. PATENT DOCUMENTS

| | | | | |
|---|---|---|---|---|
| 403,567 | A | 5/1889 | Wales | |
| 1,230,246 | A | 6/1917 | Wegwart | |
| D51,186 | S | 8/1917 | Pearson | |
| 1,654,371 | A * | 12/1927 | Goodstein | 411/443 |
| 2,748,645 | A * | 6/1956 | Peckham et al. | 411/548 |

(Continued)

FOREIGN PATENT DOCUMENTS

| | | | |
|---|---|---|---|
| CN | 1505584 | A | 6/2004 |
| CN | 201037490 | Y | 3/2008 |

(Continued)

OTHER PUBLICATIONS

EP 0 809 592 A1—English abstract and machine translation obtained from Espacenet (http://worldwide.espacenet.com) accessed on Apr. 23, 2012.

(Continued)

*Primary Examiner* — Robert J Sandy
*Assistant Examiner* — Matthew Sullivan
(74) *Attorney, Agent, or Firm* — Hahn Loeser & Parks LLP

(57) ABSTRACT

The invention relates to a closure clip for closing tubular or bag-shaped packing casing for packing loosely goods or foodstuff. The closure clip includes two arms extending at least substantially in a plane and at least substantially parallel to each other, having first and second ends and inner and outer surfaces. The closure clip further includes a bottom portion arranged in the plane defined by the arms, having an inner and an outer surface and connecting the arms by their first ends, thereby forming a substantially U-shaped closure clip. The closure clip further includes at least one arbor having a first end and a second end that extends from the inner surface of the bottom portion, to which the arbor is coupled by its first end between the arms and parallel thereto. The closure clip further comprises a die for closing the closure clip. The closure clip further comprises two guide channels for guiding the second ends of the closure clip, which are separated from each other by a land.

9 Claims, 5 Drawing Sheets

(56) References Cited

U.S. PATENT DOCUMENTS

| | | | | |
|---|---|---|---|---|
| 2,782,673 | A | 2/1957 | Packard | |
| 3,584,347 | A * | 6/1971 | Klenz | 4/30.5 W |
| 4,131,975 | A * | 1/1979 | Niedecker | 24/30.5 W |
| 4,454,875 | A | 6/1984 | Pratt et al. | |
| 4,960,420 | A | 10/1990 | Goble et al. | |
| 5,314,065 | A | 5/1994 | Ayres et al. | |
| 5,715,987 | A * | 2/1998 | Kelley et al. | 227/175.1 |
| 5,809,723 | A | 9/1998 | Keith et al. | |
| 5,852,850 | A * | 12/1998 | Hanten et al. | 24/20 R |
| 6,173,836 | B1 | 1/2001 | Cooper | |
| 6,293,399 | B1 | 9/2001 | Cooper | |
| 6,401,306 | B1 * | 6/2002 | Hanten et al. | 24/30.5 W |
| 6,446,801 | B2 | 9/2002 | Cooper | |
| 6,957,756 | B2 * | 10/2005 | Lat et al. | 227/83 |
| 7,565,780 | B2 * | 7/2009 | Pinto et al. | 53/138.4 |
| 7,666,073 | B2 | 2/2010 | Schleucher et al. | |
| 8,602,286 | B2 * | 12/2013 | Crainich et al. | 227/175.1 |
| 2002/0017473 | A1 | 2/2002 | Cooper | |
| 2007/0289252 | A1 | 12/2007 | Pinto et al. | |
| 2011/0038689 | A1 | 2/2011 | MacDonald et al. | |
| 2011/0078970 | A1 | 4/2011 | Boyd | |

FOREIGN PATENT DOCUMENTS

| | | | |
|---|---|---|---|
| DE | 195 05 359 | A1 | 9/1996 |
| DE | 195 27 875 | A1 | 1/1997 |
| DE | 197 00 692 | A1 | 7/1998 |
| EP | 0 809 592 | A1 | 12/1997 |
| EP | 1 970 321 | A1 | 9/2008 |
| JP | 2003026198 | A | 1/2003 |
| WO | 8602618 | A1 | 5/1986 |
| WO | 96 25340 | A1 | 8/1996 |

OTHER PUBLICATIONS

Abstract of EP 1 970 321 (A1) obtained from http://worldwide.espacenet.com on Sep. 15, 2011, 1 pg.

Abstract of EP 0 757 003 (A3), which corresponds to DE 195 27 875, obtained from http://worldwide.espacenet.com on Sep. 15, 2011, 1 pg.

Abstract of DE 197 00 692 (A1) obtained from http://worldwide.espacenet.com on Sep. 15, 2011, 1 pg.

* cited by examiner

CLOSURE CLIP AND DIE FOR CLOSING SAID CLIP

This application claims priority to, and the benefit of, European Patent Application No. 10 003 830.6-2308 filed Apr. 9, 2010, which is hereby incorporated by reference.

BACKGROUND OF THE INVENTION

The present invention relates to a closure clip according to the preamble of independent claims.

In particular, the present invention relates to a closure clip for closing tubular or bag-shaped packing casing for packing loosely goods or foodstuff, like fruit or vegetables. The closure clip comprises two arms extending at least substantially in a plane and at least substantially parallel to each other, having first and second ends and inner and outer surfaces facing from the arms and a bottom portion arranged in the plane defined by the two arms, having an inner and an outer surface and connecting the two arms by their first ends, thereby forming a substantially U-shaped closure clip.

The present invention further relates to a die closing a closure clip. The die has an approximately cuboid die body including a first, horizontal top surface, a second, vertical front surface and a third, vertical side surface, and an approximately semicircular recess extending from the center of the horizontal top surface into the die body. The die further comprises two guide channels for guiding the second ends of the closure clip, the guide channels are arranged in the surface of the semicircular recess parallel to each.

For storing and/or transporting loosely goods or foodstuff, like fruit or vegetables, said goods may be packed in a tubular or bag-shaped packing casing. Said tubular or bag-shaped casing may be made of e.g. web-like material. While packing, a predetermined portion or number of said goods is filled into the bag-shaped casing or a tubular casing portion closed at one end.

Clipping machines are used for packing said goods into respective packing casings, in particular, for applying closure means, like substantially U-shaped closure clips, to said packing casing for closing the packing casing. Additionally, loops for pendulous storing said packed goods, wrist straps and/or labels may be attached to the packing casing by means of the closure clip.

A generally known clipping machine for closing said packing casing and for attaching a loop or the like to the packing casing comprises, amongst others, displacer elements for gathering the filled tubular or bag-shaped packing casing and for providing a plait-like portion, and a punch and die assembly for attaching the closure clip to the plait-like portion and for closing said clip around said plait-like portion. After a plait-like portion is formed by the displacer elements, a clip is conveyed to the plait-like portion, positioned around the plait-like portion and closed by bending the arms of the U-shaped closure clip around the plait-like portion. For deforming the closure clip, said clip is pressed by the punch pushing the clip toward the die, with the tips of its arms against the die. The die comprises guide channels for guiding the arms of the clip along each other while being bent around the plait-like portion.

From EP patent application 0 809 592, a substantially U-shaped closure clip for closing bags or film tubes is known, having a bottom portion and two arms coupled to said bottom portion. At the free ends of each of the two arms, latch elements are arranged for fixedly connecting the free ends of the arms, when the closure clip is in the closed configuration, thereby the closure clip forms a closed ring. At the inner surface of the bottom portion and the arms, teeth project inwards the closure clip. In the closed configuration, said teeth engaging the bag or film tube material to prevent the closure clip from slipping off the bag or film tube material. The closure clips may be coupled to each other for forming a chain which may be stored on a clip supply, like a reel. The device for closing said closure clip comprises a die and punch assembly. The die is formed by a solid body including a recess. Said recess has tapering side surfaces for guiding the free ends of the closure clip towards each other and for coupling the free ends of the arms by the latch elements. The punch for pushing the closure clip toward the die has a lower surface directed towards the bottom portion of the closure clip. Said lower surface matches the outer surface of the bottom portion of the closure clip.

Loosely goods or foodstuff are often packed in bags of web material made of plastic. For closing said bags, clips of the above known kind are used. In case of plastic bags closed by plastic closure clips, said clips may slip off the bag neck, since the frictional force applied to the bag material by the clip may be not sufficient. If said closure clips comprise teeth, said teeth may engage the bag material, But in case of heavy goods or additionally forces to the clip, e.g. by carrying the bag, said teeth may be bent and the closure clip may be slip off the bag neck. By using metal clips, said clips may damage the bag material.

BRIEF SUMMARY OF THE INVENTION

Thus, it is an object of the present invention, to provide a closure clip and a die for closing said closure clip, with which the above mentioned drawbacks can be overcome and with which the closing of tubular or bag-shaped packing casing can be ensured.

The aforesaid object with respect to the closure clip is achieved by the features of claim 1. Advantageous configurations of the invention regarding the closure clip are described in claims 2 to 9.

According to the present invention, there is provided a closure clip for closing tubular or bag-shaped packing casing for packing loosely goods or foodstuff, like fruit or vegetables. The closure clip comprises two arms extending at least substantially in a plane and at least substantially parallel to each other, having first and second ends and inner and outer surfaces facing from the arms and a bottom portion arranged in the plane defined by the two arms, having an inner and an outer surface and connecting the two arms by their first ends, thereby forming a substantially U-shaped closure clip.

In a preferred embodiment of the closure clip, the closure clip has at least one arbor having a first end and a second end, extending from the inner surface of the bottom portion, to which the arbor is coupled by its first end, between the two arms and parallel thereto. The arbor has a length that is at least equal to the diameter of at least one of the two arms. An arbor provided at the inside of a closure clip, in particular an arbor of this length may prevent the clip from slipping off the packing material by penetrating and extending through the packing material. Moreover, in case of a web-like packing material, said arbor may very easy penetrate and extend through the packing material. Furthermore, by using a plastic material for the inventive closure clip, the arbor advantageously prevents the closure clip from slipping off the neck of plastic packing material, in particular web-like packing material.

To increase the above described effect of the arbor, the length of the arbor may amount to a multiple of the diameter of at least one of the two arms.

In a further preferred embodiment of the closure clip according to the present invention, the arbor has a length to reach at least into a gap between the two arms when the closure clip is in the closed configuration. In the closed configuration of the closure clip, the two arms are bent around the tubular or bag-shaped packing casing to be closed such that the two arms are parallel to each other and with a gap there between, with the second end of the first arm close to the first end of the second arm and the second end of the second arm close to the first end of the first arm. The arbor, extending into the gap between the two arms of the closed clip, may not be bent in a direction vertical to the plane defined by the clip, and thus, the clip may not slip off the packing casing.

According to an advantageous embodiment of the closure clip, the bottom portion is coupled to the first ends of the two arms by a curved section compassing an approximately right angle. A curved section prevents the packing casing from being damaged while closing the clip.

In this embodiment, the length of the arbor amounts to at least the sum of the smaller radius of the curved section and the diameter of at least one of the two arms to surely reach into the gap between the two arms of the closed clip.

It is preferred that the arbor is of a cross section tapering towards the second end to facilitate the engagement of the packing material. The arbor may be of a cone or a pyramidal shape.

For further facilitating the engagement and the breakthrough of the packing casing, the arbor terminates at the second end in a spike.

In an advantageous configuration, the closure clip comprises guide means for guiding the tubular or bag-shaped packing casing toward the arbor. The guide means support the packing casing neck while guided towards the arbor.

Said guide means may be of different shapes. According to a preferred embodiment, the guide means are fins attached at the inner surfaces of the two arms, forming a tapering guide channel. Said guide channel may compress the packing casing while being surrounded by the closure clip. Thereby the arbor pierces additionally packing casing layers.

The at least two arms are of a substantially rectangular cross section with one side parallel to the plane formed by the two arms. A substantially rectangular cross section may easily be adapted to a required closing force by varying the width and/or the height of said cross section.

Additionally, the closure clip may comprise a cam attached to the outer surface of the bottom portion. In this case, the punch should be provided with a respective recess mating with said cam to act as an additional guide means to improve the accuracy of the clip guidance.

According to the present invention, there is further provided a die for closing a closure clip. The die comprises an approximately cuboid die body including a first, horizontal top surface, a second, vertical front surface and a third, vertical side surface and an approximately semicircular recess extending from the center of the horizontal top surface into the die body. Two guide channels for guiding the second ends of the closure clip are arranged in the surface of the semicircular recess parallel to each other, whereby.

In an advantageous embodiment of the die, a land separates the two guide channels from each other. The land comprises a recess in its central region and in said recess, a bore is arranged, extending from the recess into the die body. The bore is arranged vertically to the top surface and parallel to the side surface of the die body. While closing the closure clip, the free end of the arbor may immerse into said hole to be prevented from being damaged. The guide channels may be arranged parallel to the side surface of the die, or in a manner that an acute angle is compassed between the guide channels and the side surface.

To allow the arbor to immerse into the bore, and to prevent the arbor from being cut by the edges of the bore, the diameter of the bore corresponds to the maximum diameter of the arbor.

It is preferred that the die comprises a further semicircular recess including further two guide channels and a further bore extending from the recess into the die body, which is incorporated in the front surface of the cuboid body. Said die may be utilized as a turnover die in the case that the guide channels incorporated in the top surface are worn out.

Naturally, further recesses may be incorporated into the bottom surface and/or the rear surface of the die body to increase the life-span of said die by providing said additionally guide channels.

Further advantages and preferred embodiments will be described in the following together with the drawings listed below. The expressions "left", "right", "below" and "above" used in the following description, are referred to the drawings in an alignment such that the reference numbers and the notation of the Figs. used can be read in normal.

DETAILED DESCRIPTION OF THE INVENTION

Figure 1A:
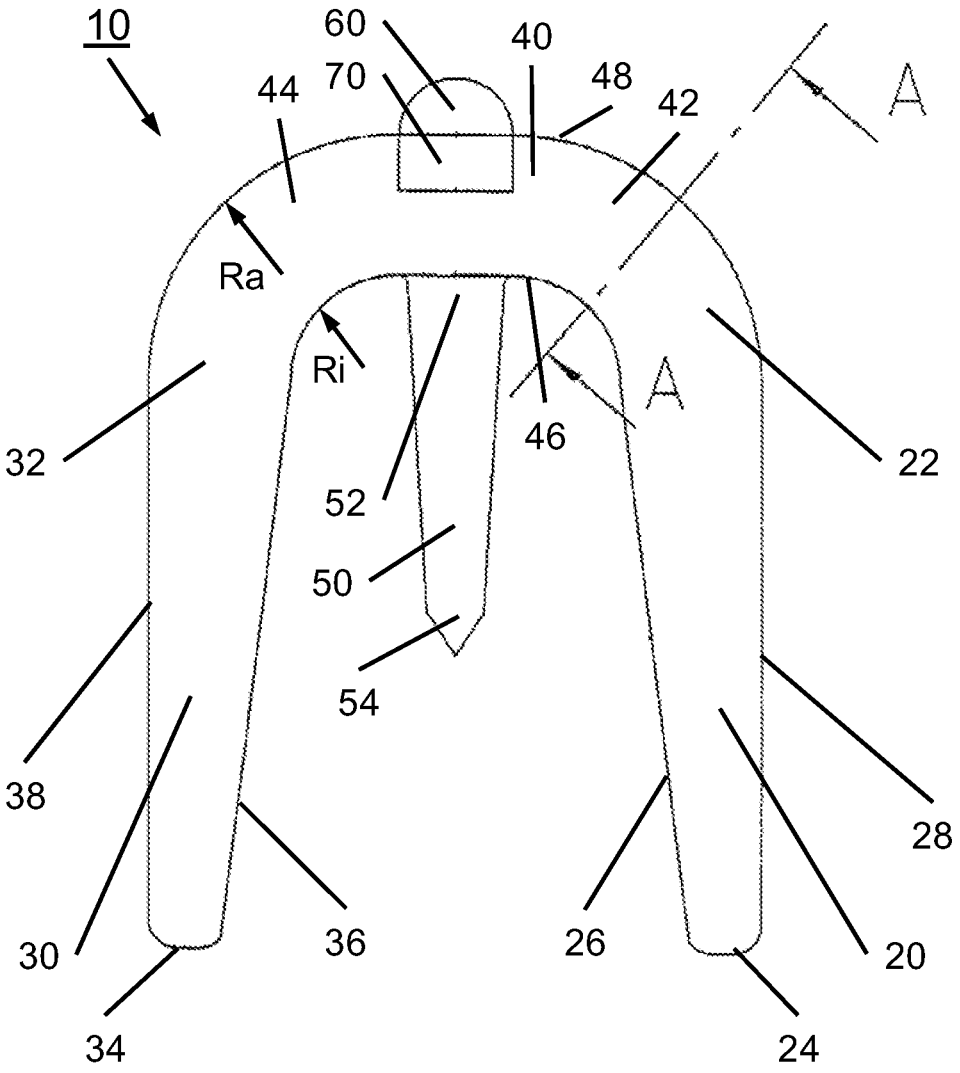
FIG. 1*a*: is a side view of a closure clip according to a first embodiment the present invention.

FIG. 1*a* is a side view of a first embodiment of a closure clip according to the present invention. As it can be seen from FIG. 1*a*, closure clip 10 is substantially U-shaped. Closure clip 10 comprises two arms 20, 30 which are coupled by a bottom portion 40.

Arms 20, 30 have first ends 22, 32, which are connected to bottom portion 40 by curved sections 42, 44. Arms 20, 30 further comprise free ends 24, 34. Arms 20, 30 are aligned parallel to each other, thereby defining a plane. Bottom section 40 is arranged in said plane and aligned substantially rectangular to arms 20, 30. Arms 20, 30 have inner surfaces 26, 36 facing inside closure clip 10, and outer surfaces 28, 38 facing away from closure clip 10. Bottom section 40 has an inner surface 46 facing inside closure clip 10, and an outer surface 48 facing away from closure clip 10. Curved sections 42, 44 have inner radii Ri and outer radii Ra.

Figure 1B:
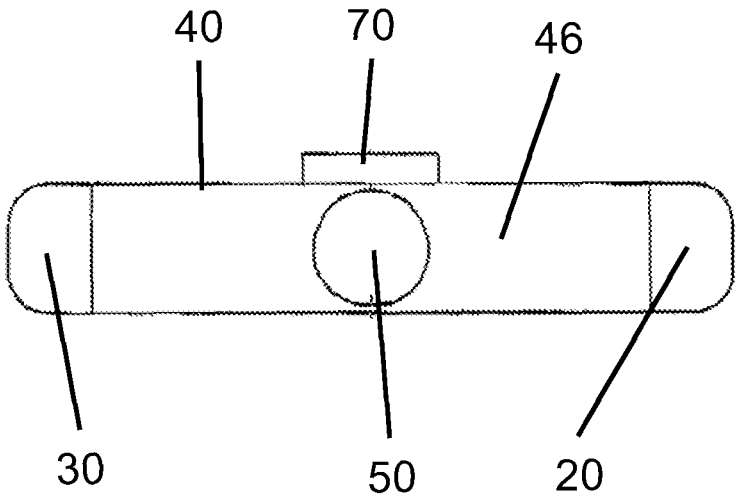
FIG. 1*b*: is a view from below to the closure clip according to FIG. 1*a;*

As it further can be seen from FIG. 1*a*, closure clip 10 comprises an arbor 50, which is attached to the inner surface 46 of bottom portion 40. Arbor 50 has a first end 52 which is coupled to inner surface 46 of bottom portion 40, and a second end 54 facing away from bottom portion 40. Arbor 50 extends in the plane defined by arms 20, 30 and substantially parallel to arms 20, 30. As shown in FIG. 1*b*, arbor 50 has a circular cross section tapering towards second end 54. Second end 54 terminates in a spike.

Furthermore, a cam 60 extends approximately from the center of outer surface 48 of bottom portion 40, opposite to arbor 50. Cam 60 has a semi-circular cross section. Closure clip 10 further has a protrusion 70 forming a bar. Said bar 70 is arranged at a side surface of bottom portion 40. Closure clips 10 are connected via bar 70 to each other building a line of clip which may be stored on a clip supply, like a clip reel.

Figure 2A:
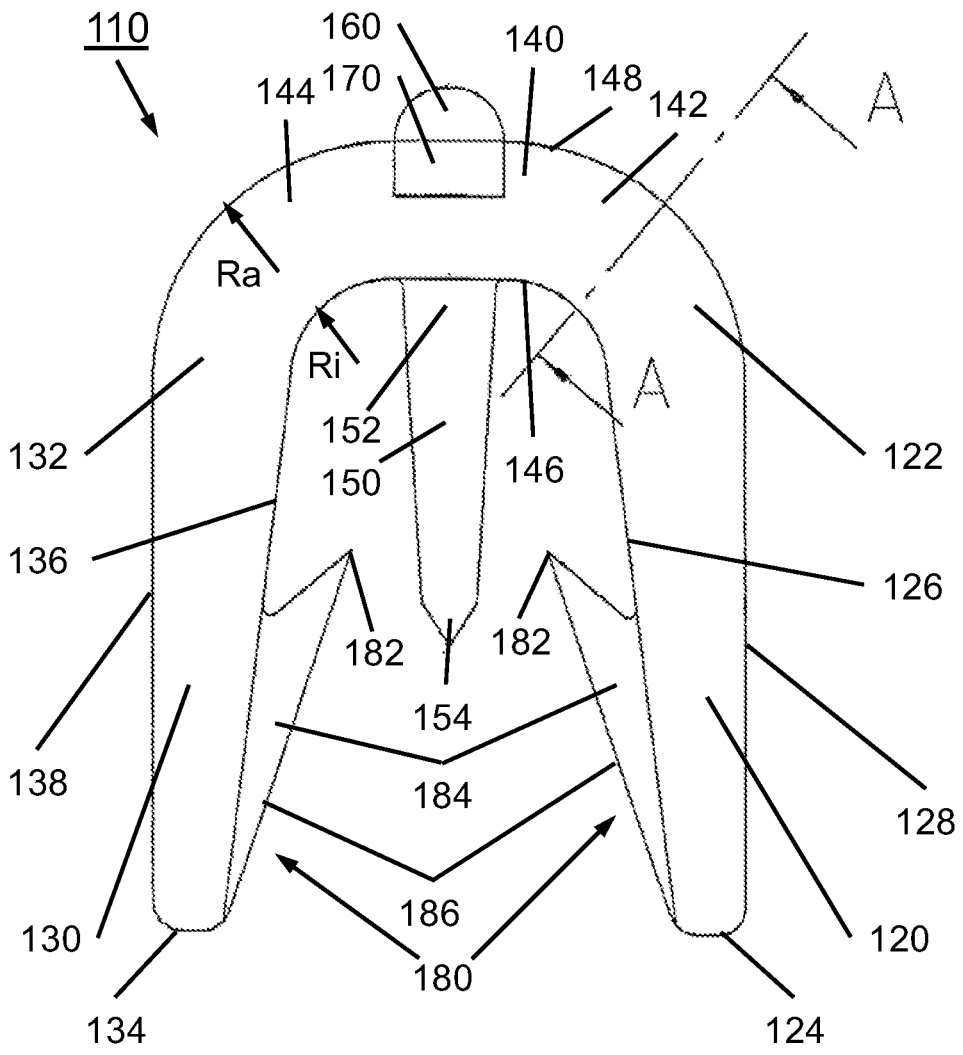
FIG. 2*a*: is a side view to a second embodiment of a closure clip according to the present invention.
Figure 2B:
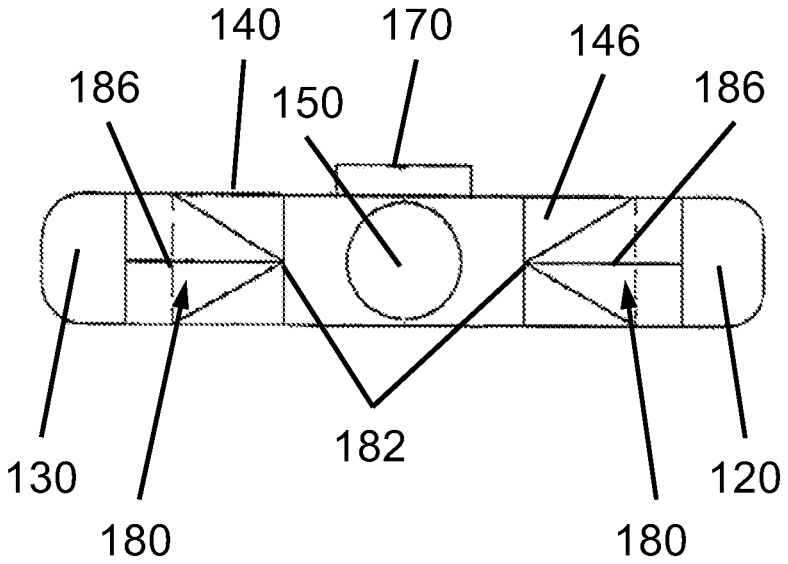
FIG. 2*b*: is a side view from below to the closure clip according to FIG. 2*a;*
Figure 2C:
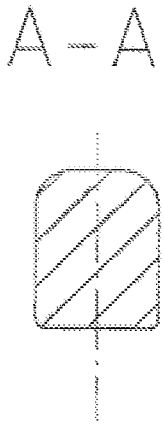
FIG. 2*c*: is a cross section view of the closure clip according to FIG. 2*a* along line A-A.

FIG. 2*a* is a side view to a second embodiment of a closure clip according to the present invention. In FIGS. 2*a* to 2*c*, elements, having the same function and the same configuration, are designated with identical reference signs increased by 100.

Closure clip 110 according to FIG. 2*a* is substantially U-shaped. Closure clip 110 comprises two arms 120, 130 having first ends 122, 132 and second ends 124, 134. First end 122, 132 of arms 120, 130 are coupled to a bottom portion 140.

Figure 1C:
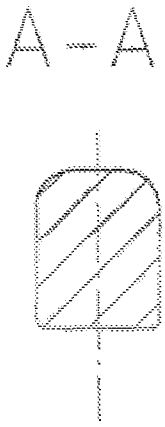
FIG. 1*c*: is a cross section view of the closure clip according to FIG. 1*a* along line A-A.

As already described in conjunction with the first embodiment of closure clip 10 according to FIGS. 1*a* to 1*c*, also arms 120, 130 of closure clip 110 are aligned parallel to each other, thereby defining a plane. Bottom section 140 is arranged in said plane and aligned substantially rectangular to arms 120, 130. Arms 120, 130 have inner surfaces 126, 136 facing inside closure clip 110, and outer surfaces 28, 38 facing away from closure clip 110. Bottom section 140 has an inner surface 46 facing inside closure clip 10, and an outer surface 48 facing away from closure clip 110. Curved sections 142, 144 have inner radii Ri and outer radii Ra.

As it further can be seen from FIG. 2*a*, closure clip 110 comprises an arbor 150, which is attached to the inner surface 146 of bottom portion 140. Arbor 150 has a first end 152 which is coupled to inner surface 146 of bottom portion 140, and a second end 154 facing away from bottom portion 140. Arbor 150 extends in the plane defined by arms 120, 130 and substantially parallel to arms 120, 130. As shown in FIG. 2*b*, arbor 150 has a circular cross section tapering towards second end 154. Second end 154 of arbor 150 terminates in a spike.

Furthermore, a cam 160 extends approximately from the center of outer surface 148 of bottom portion 140, opposite to arbor 150. Cam 160 has a semi-circular cross section. Closure clip 110 further has a protrusion 170 forming a bar. Said bar 170 is arranged at a side surface of bottom portion 140. Closure clips 110 are connected via bar 170 to each other building a line of clip which may be stored on a clip supply, like a clip reel.

As also shown in FIG. 2*a*, closure clip 110 further comprises guide means 180 in form of fins, which are attached to the inner surfaces 126, 136 of arms 120, 130, facing to the inside of clip 110.

Fins 180 are identically, tilted triangular pyramids having a top 182. Each of said triangular pyramids has a base formed by an isosceles triangle with which they are attached to the inner surfaces 126, 136 of arms 120, 130. The tip of said triangle formed by the identical legs, is aligned to the free ends 124, 134 of arms 120, 130. The basis of the triangle faces bottom portion 40. Tops 182 of said tilted triangular pyramids or fins 180 extend in a direction towards the first end 152 of arbor 150.

Each fin 180 further comprises two identical side surfaces 184 touching to each other along a common side forming edges 186. Said edges 186 extend from the tip of the triangular bases to top 182 of fins 180, thereby forming a guide channel tapering from free ends 124, 134 of arms 120, 130 towards tops 182 of fins 180. According to the second embodiment of the closure clip, tops 182 of fins 180 thereby passing spike 154 of arbor 150.

Figure 3:
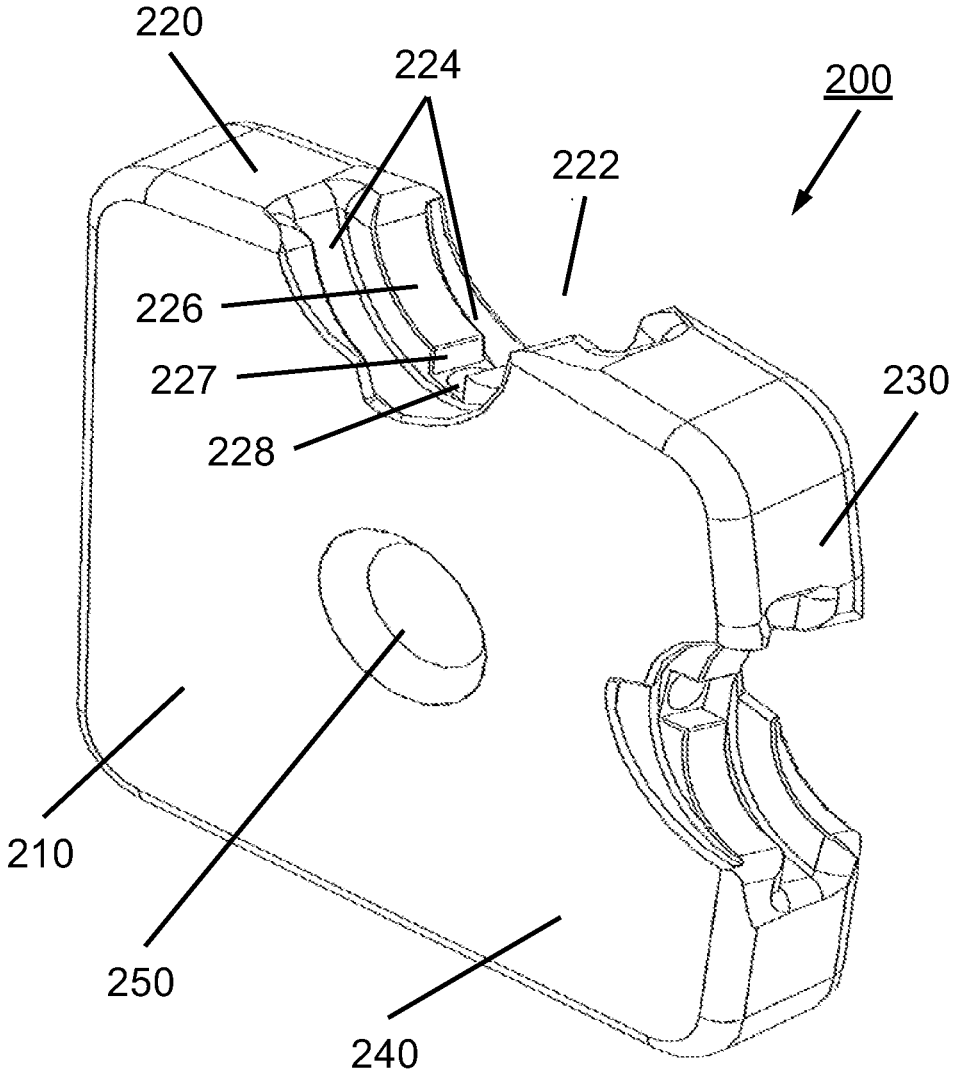
FIG. 3: is a schematic and perspective view to die for closing a closure clip according to the present invention.

FIG. 3 is a schematic and perspective view to a die for closing a closure clip according to the present invention. Die 200 has a substantially cuboid die body 210 including a first, horizontal top surface 220, a second, vertical front surface 230 and a third, vertical side surface 240.

An approximately semicircular recess 222 extends from the center of horizontal top surface 220 into die body 200. Two guide channels 224 are incorporated into the surface of semicircular recess 222. Guide channels 224 are arranged parallel to each other. An acute angle is compassed between guide channels 224 and side surface 240. A land 226 separates guide channels 224. In its central region, land 226 comprises a recess 227 in the form of a cutout which passes the complete height of land 226. A bore 228 extends from cutout 227 into die body 200. Bore 228 is arranged vertically to top surface 220 and parallel to side surfaces 230, 240 of the die body 200.

Die body 200 further comprises a mounting hole 250 for mounting die body 200 to a tool holder or a closing lever of a clipping machine. Mounting hole 250 is arranged horizontally and breaks through die body 200 from the centre of side surface 240 to the centre of the opposite side surface (not shown in FIG. 3). As it can be seen in FIG. 3, all edges of die body 200 are chamfered to prevent an operator from being injured or a closure clip from being damaged.

In the process of closing tubular or bag-shaped packing casing, said packing casing closed at one end, is manually or automatically filled with a predetermined portion or number of goods, e.g. in a clipping machine. Thereafter, the open end of the filled casing portion is gathered by the displacer elements of the clipping machine, thereby forming a plait-like portion. The clipping machine further comprises a punch and die assembly for attaching and closing a closure clip to the plait-like portion.

The punch moves towards die 200. A closure clip 10, 110 positioned in the moving path of the punch, is conveyed by the punch via guide notches towards die 200, with the free ends 24, 34, 124, 134 of the arms 20, 30, 120, 130 facing die 200. The guide notches for closure clip 10, 110 to be guided toward die 200 by the punch, are aligned to guide channels 224 of die 200. The plait-like portion of the packing casing is positioned in the conveying path so that closure clip 10, 110 surrounds the plait-like portion. While further moving closure clip 10, 110 towards die 200, free ends 24, 34, 124, 134 immerse in guide channels 224 and are guided along each other while being bent around the plait-like portion of the packing casing.

Due to the fact, that guide channels 224 of die 200 are separated by land 226, arms 20, 30, 120, 130 of closure clip 10, 110 are spaced from each other when being bent around the plait-like portion. The gap between arms 20, 30, 120, 130 corresponds to the width of land 226 of die 200.

As disclosed above, closure clip 10, 110 comprises an arbor 50, 150 extending from the inner surface 46, 146 of bottom portion 40, 140 towards the free ends 24, 34, 124, 134 of arms 20, 30, 120, 130 and parallel thereto. While attaching closure clip to the plait-like portion, arbor 50, 150 penetrates the plait-like portion and, in the case that the length of arbor 50, 150 exceeds the diameter of the plait-like portion, arbor 50, 150 extends through the plait-like portion.

During bending arms 20, 30, 120, 130 around the plait-like portion, arbor 50, 150 may immerse in bore 228 extending from recess 227 in land 226 toward the centre of die body 210. The length of arbor 50, 150 amounts at least to the sum of inner radius Ri of curved section 42, 44, 142, 144 and the diameter of arm 20, 30, 120, 130 for surely extend through the plait-like portion. The diameter of bore 228 corresponds at least approximately to the diameter of arbor 50, 150 in the region of its first end 52, 152.

In the closed configuration of closure clip 10, 110, arms 20, 30, 120, 130 are bent around the plait-like portion of the packing casing with a gap there between. Arbor 50, 150 extends through the plait-like portion and into the gap between arms 20, 30, 120, 130.

In the case of a force acting on the closed packing casing and/or on closing clip 10, 110, urging closing clip 10, 110 to slip off the plait-like portion, free, second end 54, 154 of arbor 50, 150, which extends through the plait-like portion, is supported by one of arms 20, 30, 120, 130 bent around plait-like portion. Thereby closure clip 10, 110 is prevented from slipping off the plait-like portion. Since arbor 50, 150 at least partially absorbs forces acting on closure clip 10, 110, closure clip 10, 110 may be closed with a lower closing force and/or may be made of plastic material having a lesser strength than metal.

Moreover, fruits or the like, packed into plastic bag-shaped casing made of web-material, are often scanned by a metal detector to discover contaminations. Said bags should not be closed by metal closure clips but by a plastic closure clip. In other cases, naturally, a suitable metal may be used. According to the second embodiment of a closure clip of to the present invention, as shown in FIGS. 2*a* to 2*c*, closure clip 110, additionally to the features of closure clip 10 of the first embodiment, comprises guide means in the form of fins 180. Fins 180 are identical, tilted triangular pyramids having a top 182.

As already mentioned in conjunction with FIG. 2*a*, fins 180 are attached to the inner surfaces 126, 136 of arms 120, 130 by their triangular base planes. The tip of said triangle formed by the identical legs is aligned to the free ends 124, 134 of arms 120, 130. The basis of the triangle faces bottom portion 40. Tops 182 of said tilted triangular pyramids or fins 180 extend in a direction towards the first end 152 of arbor 150.

Edges 186 formed by the respective two identical side surfaces 184 extend from the tip of the triangular bases to top 182 of fins 180, thereby forming a guide channel tapering from free ends 124, 134 of arms 120, 130 towards tops 182 of fins 180.

By using closure clip 110 for closing a bag-shaped or tubular packing casing, the plait-like portion formed by the displacer elements, is guided by fins 180 towards arbor 50, 150. Caused by the tapering guide path between fins 180, the plait-like portion of the bag-shaped or tubular packing casing is guided toward the spike formed by second end 154 of arbor 150; thereby the plait-like portion will be compressed or at least halt in its present compressed state by fins 180. While arbor 150 penetrates the plate-like portion of bag-shaped or tubular packing casing, fins 180 supporting the plait-like portion and preventing the plait-like portion from expanding or leaving its compressed state.

As mentioned above, closure clip 10, 110 comprises a cam 60, 160. A punch for being used in conjunction with clip 10, 110, naturally comprises a respective notch for being engaged by cam 60, 160, preventing closure clip 10, 110 from turning while being moved towards die 200 by the punch.

According to FIGS. 1*c* and 2*c*, closure clip has a substantially rectangular cross section. Clip 10, 110 may also have any other suitable cross section, like a circular or triangular cross section. Moreover, also arbor 50, 150 may have other than a circular cross section, e.g. a rectangular or triangular cross section.

The invention claimed is:

1. A closure clip for closing tubular or bag-shaped packing casing for packing loosely goods or foodstuff comprising:

two arms extending at least substantially in a plane and at least substantially parallel to each other, having first and second ends and inner and outer surfaces facing from the arms;

a bottom portion arranged in the plane defined by the arms, having an inner and an outer surface, and connecting the arms by their first ends, thereby forming a substantially U-shaped closure clip; and at least one arbor having a first end and a second end, extending from the inner surface of the bottom portion, to which the arbor is coupled by its first end, between the arms and parallel thereto, wherein the arbor has a length that is at least equal to the diameter of at least one of the arms;

wherein the closure clip further comprises guide means for guiding the tubular or bag-shaped packing casing towards the arbor; and wherein the guide means are fins attached at the inner surfaces of the arms, forming a tapering guide channel.

2. The closure clip according to claim 1, wherein the length of the arbor amounts to a multiple of the diameter of at least one of the arms.

3. The closure clip according to claim 1, wherein the arbor has a length to reach at least into a gap between the arms when the closure clip is in a closed configuration, wherein for the closed configuration of the closure clip, the arms are adapted to be bent around the tubular or bag-shaped packing casing to be closed such that the arms are parallel to each other and with a gap there between, with the second end of one of the arms close to the first end of another of the arms and the second end of the another of the arms close to the first end of the one of the arms.

4. The closure clip according to claim 1, wherein the bottom portion is coupled to the first ends of the arms by a curved section compassing an approximately right angle.

5. The closure clip according to claim 4, wherein the length of the arbor amounts to at least the sum of the inner radius of curved sections and the diameter of at least one of the arms.

6. The closure clip according to claim 1, wherein the arbor is of a cross section tapering towards the second end.

7. The closure clip according to claim 1, wherein the arbor terminates at the second end in a spike.

8. The closure clip according to claim 1, wherein the at least the two arms are of a substantially rectangular cross section with one side parallel to the plane formed by the arms.

9. The closure clip according to claim 1, wherein the closure clip comprises a cam attached to the outer surface of the bottom portion.

* * * * *